US012601516B2

(12) United States Patent
Stevenson et al.

(10) Patent No.: US 12,601,516 B2
(45) Date of Patent: Apr. 14, 2026

(54) AUTOMATED COOLING SYSTEM FOR A BUILDING STRUCTURE

(71) Applicant: QC Manufacturing, Inc., Temecula, CA (US)

(72) Inventors: Dana Charles Stevenson, Canyon Lake, CA (US); Dustin Martin Stevenson, Menifee, CA (US)

(73) Assignee: QC Manufacturing, Inc., Temecula, CA (US)

( * ) Notice: Subject to any disclaimer, the term of this patent is extended or adjusted under 35 U.S.C. 154(b) by 775 days.

(21) Appl. No.: 17/898,298

(22) Filed: Aug. 29, 2022

(65) Prior Publication Data

US 2022/0412588 A1 Dec. 29, 2022

Related U.S. Application Data

(63) Continuation of application No. 17/527,007, filed on Nov. 15, 2021, now Pat. No. 11,460,204, which is a (Continued)

(51) Int. Cl.

| | |
|---|---|
| ***F24F 11/00*** | (2018.01) |
| ***F24F 7/013*** | (2006.01) |
| ***F24F 7/02*** | (2006.01) |
| ***F24F 11/64*** | (2018.01) |
| ***F24F 11/89*** | (2018.01) |

(Continued)

(52) U.S. Cl.

CPC ..... *F24F 11/0001* (2013.01); *F24F 7/013* (2013.01); *F24F 7/025* (2013.01); *F24F 11/64* (2018.01); *F24F 11/89* (2018.01); *F24F 2007/0025* (2021.01); *F24F 2011/0002* (2013.01); *F24F 11/56* (2018.01); *F24F 2110/10* (2018.01); *F24F 2110/22* (2018.01)

(58) Field of Classification Search

CPC ..... F24F 11/0001; F24F 7/013; F24F 11/64; F24F 11/89; F24F 2110/10

USPC ..... 454/239

See application file for complete search history.

(56) References Cited

U.S. PATENT DOCUMENTS 2,612,831 A 10/1952 Lohman, Jr.
3,324,672 A * 6/1967 Sones ..... F24F 11/84 62/226

(Continued)

OTHER PUBLICATIONS

QuietCool AFG, GA, GX, and RM Models, Specialty Series Fans, Installation Guide, May 18, 2016.

(Continued)

*Primary Examiner* — Allen R. B. Schult
*Assistant Examiner* — William C Weinert
(74) *Attorney, Agent, or Firm* — Knobbe, Martens, Olson & Bear, LLP

(57) ABSTRACT

An automated cooling system and method for energy efficient use with a building structure by adjusting operational parameters is provided. The automated cooling system can adjust operational parameters in response to conditions (e.g., temperature, humidity) detected by sensors located at one or more strategically selected locations inside or outside the building structure. The automated cooling system can ramp speeds of a motor that rotates fan blades in response to changes in the air temperature in the building structure so as to maintain a desired temperature without switching on and off the motor to preserve fan blade inertia.

33 Claims, 10 Drawing Sheets

Related U.S. Application Data continuation of application No. 15/486,250, filed on Apr. 12, 2017, now Pat. No. 11,175,056.

(51) Int. Cl.

| | |
|---|---|
| *F24F 7/00* | (2021.01) |
| *F24F 11/56* | (2018.01) |
| *F24F 110/10* | (2018.01) |
| *F24F 110/22* | (2018.01) |

(56) References Cited

U.S. PATENT DOCUMENTS

| | | | | |
|---|---|---|---|---|
| 3,990,063 | A | 11/1976 | Schuman | |
| 3,990,069 | A | 11/1976 | Schuman | |
| 4,344,479 | A | 8/1982 | Bailey | |
| 4,421,268 | A * | 12/1983 | Bassett | F24F 11/64 431/20 |
| 4,977,818 | A | 12/1990 | Taylor et al. | |
| 4,991,657 | A | 2/1991 | LeLande, Jr. | |
| 5,014,770 | A | 5/1991 | Palmer | |
| 5,049,801 | A | 9/1991 | Potter | |
| 5,528,229 | A * | 6/1996 | Mehta | F04D 25/088 454/258 |
| 5,996,898 | A | 12/1999 | Parker et al. | |
| 6,215,659 | B1 | 4/2001 | Chen | |
| 6,599,341 | B2 * | 7/2003 | Goyetche | B01D 46/62 55/438 |
| 7,497,774 | B2 | 3/2009 | Stevenson et al. | |
| 7,591,433 | B2 | 9/2009 | Wang et al. | |
| 7,850,513 | B1 | 12/2010 | Parker et al. | |
| 8,079,898 | B1 | 12/2011 | Stevenson | |
| 8,123,142 | B2 | 2/2012 | Cislo | |
| 8,368,240 | B1 | 2/2013 | Burkett | |
| 9,582,011 | B2 | 2/2017 | Potter | |
| 10,830,464 | B1 | 11/2020 | Stevenson | |
| 11,175,056 | B1 | 11/2021 | Stevenson et al. | |
| 2003/0190885 | A1 | 10/2003 | Johnsons, Jr. | |
| 2005/0239394 | A1 | 10/2005 | O'Hagin et al. | |
| 2005/0277381 | A1 | 12/2005 | Banerjee et al. | |
| 2006/0035581 | A1 | 2/2006 | Stevenson et al. | |
| 2006/0037334 | A1 | 2/2006 | Tien et al. | |
| 2007/0028635 | A1 | 2/2007 | Gleeson | |
| 2007/0096665 | A1 | 5/2007 | Ku et al. | |
| 2007/0130850 | A1 | 6/2007 | Miekka | |
| 2007/0178827 | A1 | 8/2007 | Erni | |
| 2007/0197158 | A1 | 8/2007 | Byczynski | |
| 2007/0213003 | A1 | 9/2007 | Railkar et al. | |
| 2007/0243820 | A1 | 10/2007 | O'Hagin | |
| 2008/0073439 | A1 | 3/2008 | Lestage et al. | |
| 2008/0113612 | A1 | 5/2008 | Chich et al. | |
| 2008/0314998 | A1 | 12/2008 | Herzon et al. | |
| 2009/0099696 | A1 | 4/2009 | Artman et al. | |
| 2009/0125159 | A1 | 5/2009 | Shen et al. | |
| 2009/0186570 | A1 | 7/2009 | Riggins | |
| 2010/0163633 | A1 | 7/2010 | Barrett et al. | |
| 2010/0304660 | A1 | 12/2010 | Boehling et al. | |
| 2010/0330898 | A1 | 12/2010 | Daniels | |
| 2011/0048245 | A1 | 3/2011 | Schjerven, Sr. et al. | |
| 2011/0124280 | A1 | 5/2011 | Railkar et al. | |
| 2011/0217194 | A1 | 9/2011 | Randall | |
| 2011/0316279 | A1 | 12/2011 | Bahari et al. | |
| 2012/0038162 | A1 | 2/2012 | Smith, Jr. et al. | |
| 2012/0045983 | A1 | 2/2012 | Eskola, III | |
| 2012/0079840 | A1 | 4/2012 | Lukasse et al. | |
| 2012/0190292 | A1 | 7/2012 | Skrepcinski et al. | |
| 2013/0040553 | A1 | 2/2013 | Potter | |
| 2013/0074428 | A1 | 3/2013 | Allen et al. | |
| 2013/0223976 | A1 | 8/2013 | Smith et al. | |
| 2014/0081468 | A1 * | 3/2014 | Potter | F24F 11/65 700/278 |
| 2014/0105738 | A1 | 4/2014 | Bassett | |
| 2014/0105743 | A1 | 4/2014 | Bassett | |
| 2014/0120818 | A1 | 5/2014 | Bennett | |
| 2014/0206278 | A1 | 7/2014 | Stevenson | |
| 2014/0242898 | A1 | 8/2014 | Richards | |
| 2015/0079896 | A1 | 3/2015 | Stocker | |
| 2015/0098180 | A1 | 4/2015 | Berghe | |
| 2015/0118017 | A1 | 4/2015 | Yato | |
| 2015/0285524 | A1 | 10/2015 | Saunders | |
| 2016/0010886 | A1 | 1/2016 | Dukes | |
| 2016/0084227 | A1 | 3/2016 | Krippene | |
| 2016/0237884 | A1 | 8/2016 | Yamada et al. | |
| 2016/0278517 | A1 * | 9/2016 | DeLorean | F24F 7/007 |
| 2017/0022877 | A1 | 1/2017 | Sirovatka et al. | |
| 2017/0211833 | A1 * | 7/2017 | Tran | F25B 49/022 |
| 2018/0031266 | A1 | 2/2018 | Atchison et al. | |
| 2018/0045206 | A1 | 2/2018 | Birk et al. | |
| 2018/0080670 | A1 | 3/2018 | Carlyon et al. | |
| 2018/0180299 | A1 | 6/2018 | Hallit et al. | |
| 2018/0245814 | A1 | 8/2018 | Yan et al. | |
| 2018/0267566 | A1 | 9/2018 | Locke et al. | |
| 2019/0037770 | A1 | 2/2019 | Dugas et al. | |
| 2019/0353369 | A1 | 11/2019 | George et al. | |

OTHER PUBLICATIONS

QuietCool AFG SLR & AFR SLR Models, Solar Attic Fans, Owner's Guide, revised May 13, 2019.

QuietCool Attic Fan web page of Sep. 29, 2020 downloaded from the Wayback Machine at https://web.archive.org/web/20200929113122/https://quietcoolsystems.com/attic-fan (Year: 2020).

* cited by examiner

AUTOMATED COOLING SYSTEM FOR A BUILDING STRUCTURE

INCORPORATION BY REFERENCE TO ANY PRIORITY APPLICATIONS

Any and all applications for which a foreign or domestic priority claim is identified in the Application Data Sheet as filed with the present application are incorporated by reference under 37 CFR 1.57 and made a part of this specification.

BACKGROUND

Field

Certain embodiments discussed herein relate to an attic fan, and more particularly, to an attic fan that automatically adjusts its operation to maximize cooling efficiency.

Description of the Related Art

Attic fans are intended to cool hot attics by exhausting super-heated air from the attic and drawing cooler outside air into the attic. Attic fans are mounted on an attic gable wall or slope of a roof and push hot attic air through a vent to the outside. Attic vents near the floor of the attic (e.g., soffit vents or other types of vents) allow cooler outside air to flow into the attic to replace the air that is vented from the attic by the attic fan. Overheated attics can cause premature failure of building materials (e.g., roofing, sheathing, joists, rafters, insulation, air conditioning ducts, etc.). Cooling the attic can reduce the cost of cooling the living space. Attic fans can also help to control the damage caused by moisture and humidity in the attic.

What is needed is an attic fan cooling system that improves the energy efficiency of the attic fan and the cooling of the attic and living space.

SUMMARY

The systems, methods and devices described herein have innovative aspects, no single one of which is indispensable or solely responsible for their desirable attributes. Without limiting the scope of the claims, some of the advantageous features will now be summarized.

The present disclosure discloses various embodiments of a smart attic fan assembly designed to approach cooling efficiency and energy savings in a proactive way instead of the traditional reactive approach. The smart attic fan assembly's proactive approach will achieve less cost of use of fan, longer life cycle, less over heating of attic, which will reduce energy cost of cooling of attic and living space, helping reduction of premature failure of roofing, structure, wood members, insulation, etc., as well as reducing moisture and humidity problems in attics.

In some embodiments, the smart attic fan assembly includes a motor, a fan blade assembly, a condition sensor, and a control unit. The motor is configured to rotate a fan drive shaft. The fan blade assembly is rotationally secured to the fan drive shaft so that rotation of the fan drive shaft causes the fan blade assembly to rotate. The control unit is electrically coupled to the condition sensor and configured to receive a condition sensor signal transmitted by the condition sensor. The control unit is electrically coupled to the motor and configured to transmit a change in speed at which the motor rotates the fan drive shaft.

In some embodiments, the smart attic fan assembly can include one or more of the following features: The motor signal changes the speed based on the condition sensor signal. The condition sensor can comprise a temperature sensor or a humidistat. The smart attic fan assembly further includes a user interface that allows a desired temperature setting to be selected. The user interface is electronically coupled to the control unit and configured to transmit a user interface signal to the control unit to inform the control unit of the desired temperature setting. The control unit is configured to determine a target speed based on the condition sensor signal, determine a present speed based on the speed sensor, send a first motor signal to increase the speed when the target speed is greater than the present speed, send a second motor signal to decrease the speed when the target speed is less than the present speed, and send a third motor signal to keep unchanged the speed when the target speed equals the present speed. In certain embodiments, the condition sensor is a temperature sensor mounted directly on the motor. In certain embodiments, the condition sensor is a temperature sensor mounted on a bracket that connects the motor to a housing of the smart attic fan assembly. In certain embodiments, the smart attic fan assembly further includes a housing that circumferentially surrounds the motor. The condition sensor can be a temperature sensor that is mounted on a surface of the housing that faces the motor. The condition sensor is a temperature sensor that is mounted directly on a portion of a building structure to which the attic fan assembly is attached. The motor can be an electronically commutated motor.

In some embodiments, an energy efficient, smart attic fan system is disclosed. The attic fan system comprises a fan motor, a condition sensor, and a controller. The condition sensor is strategically located to sense one or more ambient conditions in an attic. The condition sensor communicates the one or more ambient conditions to the controller, which in turn modulates the speed of the fan motor in response to the one or more ambient conditions so as to maintain the one or more ambient conditions within a predetermined range.

In some embodiments, a method of operating an attic fan assembly is disclosed. The method includes rotating a fan at a first speed to create an airflow that exhausts air from an attic; detecting a temperature of the air in the airflow; comparing the temperature to a target temperature; rotating the fan at a second speed when the temperature is higher than the target temperature, the second speed being greater than the first speed; rotating the fan at a third speed when the temperature is lower than the target temperature, the third speed being less than the first speed; and maintaining the fan at the first speed when the temperature is equal to the target temperature.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
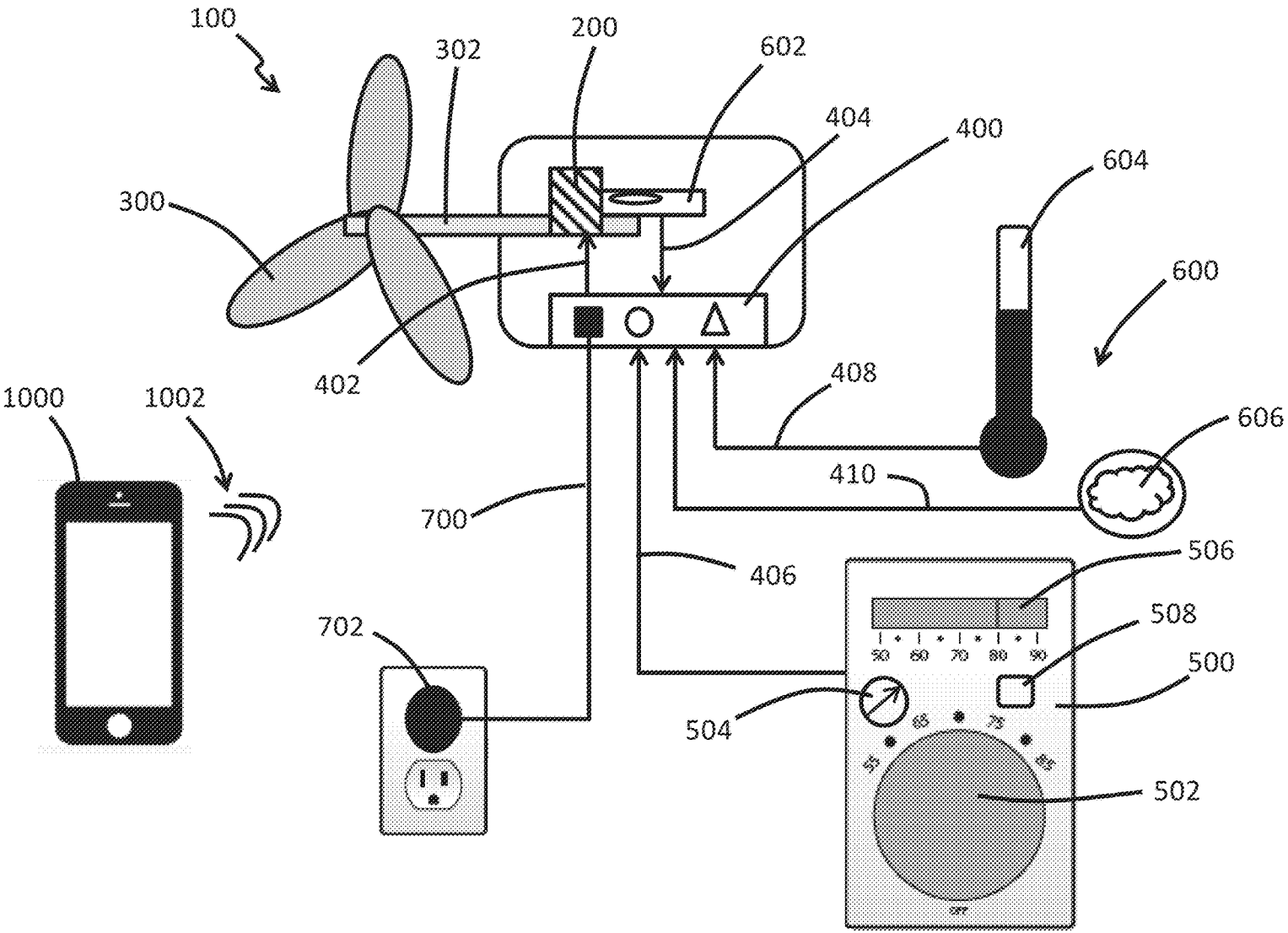
FIG. 1 is a schematic diagram of an embodiment of a smart attic fan assembly.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extend beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

Embodiments of the present disclosure provide for an energy-efficient, automated attic fan cooling system. In some aspects, the present disclosure is directed to a programmable attic fan that maximizes energy-efficiency by adjusting operational parameters of the fan to prevent or reduce overheating of an attic space. In some arrangements, the smart attic fan assemblies disclosed herein adjust operational parameters of the fan motor in response to conditions (e.g., temperature, humidity) detected by sensors located at one or more strategically selected locations inside the attic space, inside the living space, or outside of the structure. As described in more detail below, the systems and methods disclosed herein minimize energy consumption of the attic fan motor during the ventilation of the attic. The systems and methods reduce the energy consumption required to maintain a temperature of an attic space at a desired setpoint or within a desired range of temperatures having a minimum temperature setpoint and a maximum temperature setpoint. The systems and methods reduce the energy consumption required to maintain the humidity of an attic space at a desired setpoint or within a desired range of humidity having a minimum humidity setpoint and a maximum humidity setpoint. In certain arrangements, the apparatuses, methods, and cooling systems disclosed herein provide energy-efficient ventilation regimes that minimize heat conduction from an attic to a living space.

FIG. 1 depicts a schematic diagram of a non-limiting, illustrative embodiment of a smart attic fan assembly 100. The smart attic fan assembly 100 can include a motor 200, a fan blade assembly 300, a control unit 400, a user interface 500, and one or more sensors 600. The motor 200 can be connected to the fan blade assembly 300 by a fan drive shaft 302. The motor 200 can rotate the fan drive shaft 302 to drive a rotation of the fan blade assembly 300. In some arrangements, the motor 200 can be an electronically commutated motor (ECM). ECM type motors are direct current (DC) motors that function using a built-in inverter and a magnet rotor, allowing the motor to achieve greater efficiency in air-flow systems compared to some alternating current (AC) motors. Although AC current is used for ECM, the internal rectifier of the ECM converts the current to DC voltage. An ECM uses a compact external rotor design with stationary windings. Permanent magnets are mounted inside the rotor of the ECM. In an ECM type motor, the mechanical commutation has been replaced by electronic circuitry. The electronic circuitry of the ECM supplies the correct amount of armature current in the correct direction at the correct time for accurate motor control.

As discussed in more detail below, the smart attic fan assembly 100 can be adapted to rotate the fan blade assembly 300 at different revolutions per minute (rpm). In certain arrangements, the operation of the motor 200 can be controlled by the control unit 400. For example, the control unit 400 can send a motor signal 402 to the motor 200 to control the speed (e.g., rpm) at which the motor 200 drives rotation of the fan blade assembly 300. In some arrangements, the motor 200 is an ECM and the control unit 400 controls the operation of the motor 200 by controlling the armature current of the motor 200. As discussed below, the control unit 400 can adjust the speed (e.g., rpm) of the fan blade assembly 300 in response to information received by the control unit 400 from one or more sensors 600 of the smart attic fan assembly 100. The control unit 400 can include one or more electrical circuits and/or processors. The control unit 400 can include a printed circuit board (PCB).

The smart attic fan assembly 100 can include a speed sensor 602 that is adapted to detect the rpm of the fan blade assembly 300. The speed sensor 602 can be an infrared sensor that detects the passing of a light or dark mark on the rotating fan drive shaft 302. The speed sensor 602 can be a voltage sensor or a current sensor. The control unit 400 can be programmed to covert a voltage or a current detected by the speed sensor 602 to a speed of the fan blade assembly 300. For example, the fan blade assembly 100 can have a speed sensor 602 that detects a voltage supplied to the motor 200. The control unit 400 can be programmed to have a look-up table or characteristic curve that allows the control unit 400 to convert the detected voltage from the speed sensor 602 to a corresponding rpm value for the fan blade assembly 300. The speed sensor 602 can detect a voltage or a current supplied to the motor 200 or to another component of the smart attic fan assembly 100. In some arrangements, the speed sensor 602 is a Hall effect sensor that detects the passing of a magnet on the rotating fan drive shaft 302. The speed sensor 602 can send a fan speed signal 404 to the control unit 400, as shown in FIG. 1. The control unit 400 can adjust the motor signal 402 based on the fan speed signal 404 received by the control unit 400 from the speed sensor 602. In some arrangements, the control unit 400 and the speed sensor 602 can provide a feedback loop that allows the smart attic fan assembly 100 to tightly regulate the rotational speed of the fan blade assembly 300. For example, if the speed sensor 602 informs the control unit 400 that the fan speed (e.g., rpm) is less than a desired speed, the control unit 400 can change the motor signal 402 to cause the motor 200 to increase the speed at which the motor 200 is rotating the fan drive shaft 302. If the speed sensor 602 informs the control unit 400 that the fan speed (e.g., rpm) is greater than a desired speed, the control unit 400 can change the motor signal 402 to cause the motor 200 to decrease the speed at which the motor 200 is rotating the fan drive shaft 302.

With continued reference to FIG. 1, the smart attic fan assembly 100 can allow a user to select various settings with regard to the operation of the smart attic fan assembly 100. For example, the user interface 500 can have a temperature dial 502. The temperature dial 502 can allow a user to select a desired temperature for a room (e.g., attic) in which the smart attic fan assembly 100 is installed. The user interface 500 can include a humidity control dial 504. The humidity control dial 504 can allow a user to select a desired humidity for the room in which the smart attic fan assembly 100 is installed. The user interface 500 can include other dials (not shown) that allow a user to select other operational modes of the smart attic fan assembly 100, as discussed in more detail below. The user interface 500 can send an interface signal 406 to the control unit 400. The control unit 400 can receive the interface signal 406 from the user interface 500. The user interface signal 406 can inform the control unit 400 of the settings that have been selected on the user interface 500.

The user interface 500 can include a display 506. The display 506 can display the reading of a sensor 600 of the smart attic fan assembly 100. The user interface 500 can include a toggle button 508 that allows a user to scroll through the readings for each of the multiple sensors 600 of the smart attic fan assembly 100. For example, the smart attic fan assembly 100 can include a temperature sensor 604 located on or in the user interface 500. The temperature sensor 604 can inform the user or the control unit 400 of the current temperature of the room in which the smart attic fan assembly 100 is installed. In some arrangements, the display 506 can show the current reading from the speed sensor 602 to inform a viewer or the control unit 400 of the current rpm of the fan blade assembly 300. The smart attic fan assembly 100 can include a humidistat 606. The humidistat 606 can be located on or in the user interface 500. The humidistat 606 can inform the user or the control unit 400 of the humidity of the room in which the smart attic fan assembly 100 is installed. The display 506 can show the current reading from the humidistat 606.

The smart attic fan assembly 100 can include a temperature sensor 604 located at a location other than on or in the user interface 500. For example, the smart attic fan assembly 100 can include a temperature sensor 604 located outside the building structure to inform the control unit 400 of the current outside temperature. The smart attic fan assembly 100 can include multiple temperature sensors 604 located at different locations. In some arrangements, a first temperature sensor 604 can be located near the floor of the attic and a second temperature sensor 604 can be located near the roof of the attic. In certain arrangements, the smart attic fan assembly 100 includes a temperature sensor 604 located within the living space of the building structure. The toggle button 508 can allow a user to scroll through the temperature readings for each of the multiple temperature sensors 604. The temperature sensor 604 can send a temperature signal 408 to the control unit 400. The control unit 400 can receive the temperature signal 408 from the temperature sensor 604. The temperature signal 408 can inform the control unit 400 of the temperature at the location of the temperature sensor 604.

The smart attic fan assembly 100 can include a humidistat 606 located at a location other than on or inside the user interface 500. For example, the smart attic fan assembly 100 can include a humidistat 606 located outside the building structure to inform the user or the control unit 400 of the current humidity outside. The smart attic fan assembly 100 can include multiple humidistats 606 located at different locations. In some arrangements, a first humidistat 606 can be located in the attic space and a second humidistat 606 can be located inside the living space of the building structure or outside of the building structure. The toggle button 508 can allow a user to scroll through the humidity readings for each of the multiple humidistats 606. The humidistat 606 can send a humidity signal 410 to the control unit 400. The control unit 400 can receive the humidity signal 410 from the humidistat 606. The humidity signal 410 can inform the control unit 400 of the humidity at the location of the humidistat 606.

The user interface 500 can be adapted to allow a user to set operational setpoints for the smart attic fan assembly 100. The operational setpoints can define conditions that trigger the smart attic fan assembly 100 to perform an action (e.g., turn on fan, speed up fan, pulse fan, slow down fan). The smart attic fan assembly 100 can compare the operational setpoints to a reading (e.g., temperature, humidity) detected by a sensor 600. For example, the user interface 500 can allow a user to set an operational setpoint for a desired temperature in the attic. The smart attic fan assembly 100 can compare the desired temperature in the attic to a reading from a temperature sensor 604 located in an air flow path of the smart attic fan assembly 100. The smart attic fan assembly 100 can speed up the rpm of the motor 200 if the temperature in the attic exceeds the desired temperature. The smart attic fan assembly 100 can slow down the rpm of the motor 200 if the temperature in the attic is below the desired temperature. In some arrangements, the user interface 500 can allow a user to set an operational setpoint for a desired humidity in the attic. The smart attic fan assembly 100 can compare the desired humidity in the attic to a reading from a humidity sensor 604 located in the attic. The smart attic fan assembly 100 can start or speed up the rpm of the motor 200 if the humidity in the attic exceeds the desired humidity. The smart attic fan assembly 100 can stop or slow down the rpm of the motor 200 if the humidity in the attic is below the desired humidity. The smart attic fan assembly 100 can include a humidistat 606 located outside of the building structure. The smart attic fan assembly 100 can compare the reading of the humidistat 606 located outside of the building structure to the desired humidity in the attic. The smart attic fan assembly 100 can start or speed up the rpm of the motor 200 if the humidity outside of the building structure is less than the desired humidity in the attic. The smart attic fan assembly 100 can stop or slow down the rpm of the motor 200 if the humidity outside of the building structure is greater than the desired humidity in the attic.

As shown in FIG. 1, the smart attic fan assembly 100 can include a power cord 700 that is adapted to plug into an outlet 702. In some arrangements, the power cord 700 can be wired directly to a power source and need not interface with the outlet 702 through a plug. The power cord 700 can deliver power from the outlet 702 to the smart attic fan assembly 100. In the illustrated embodiment, the power cord 700 connects to the control unit 400. The smart attic fan assembly 100 can be arranged differently. For example, the power cord 700 can supply power directly to the motor 200, which in turn supplies power to the control unit 400. In some arrangements, an intervening device (not shown) distributes power to the components of the smart attic fan assembly 100. In the illustrated embodiment, the control unit 400 is shown spaced apart from the motor 200. In certain variants, the control unit 400 can be mounted onto the motor 200.

The smart attic fan assembly 100 can include a wireless transmitter and/or a wireless receiver (not shown) that allows the smart attic fan assembly 100 to communicate with a mobile device 1000 (e.g., smart phone, tablet, etc.). The mobile device 1000 can send a signal 1002 to the smart attic fan assembly 100 to check or change the operation of the smart attic fan assembly 100. For example, a user can have a mobile device 1000 that includes a software application (app) that allows the user to increase or decrease the speed of the motor 200.

Figure 2:
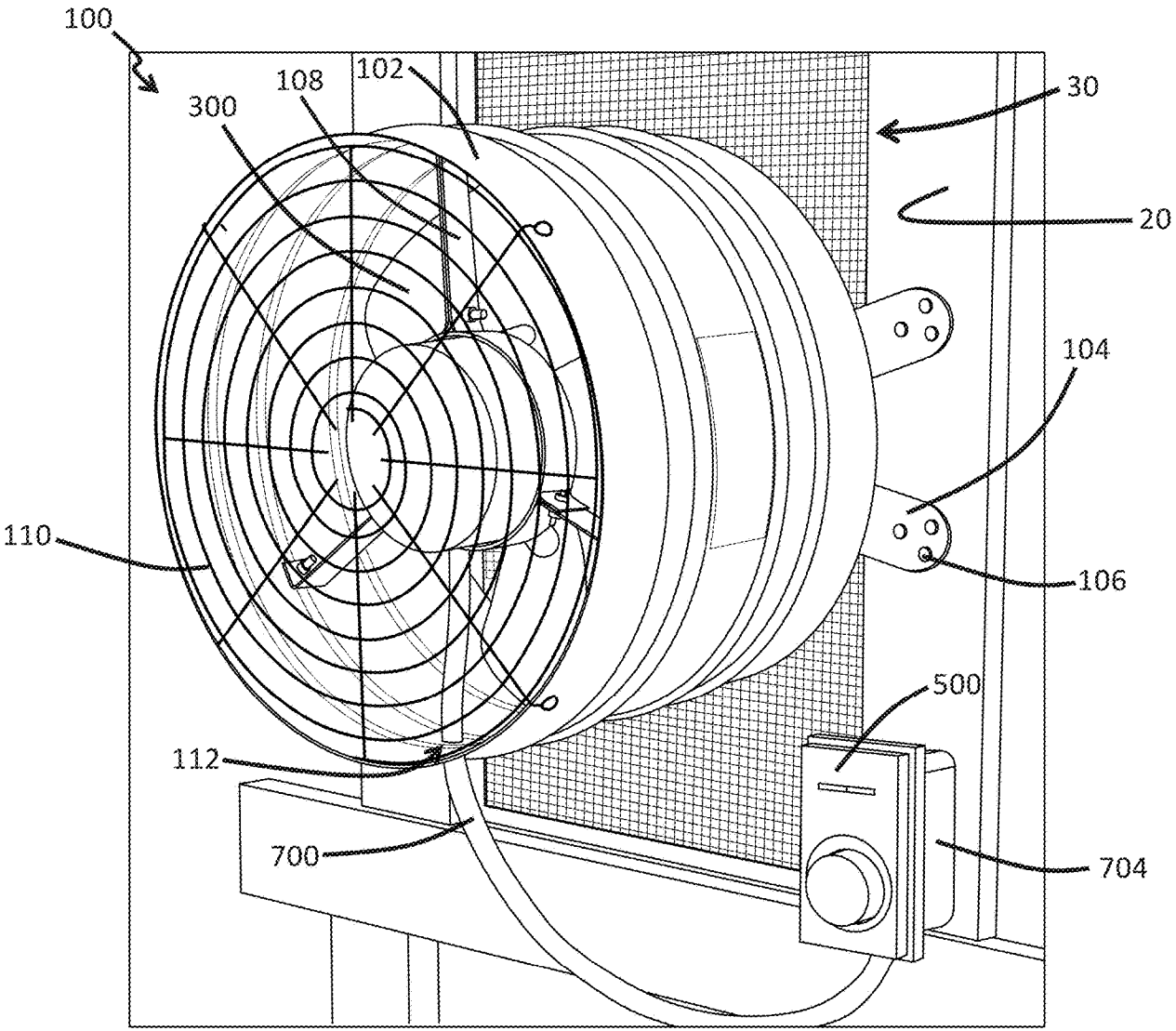
FIG. 2 shows a smart attic fan assembly mounted on a framing of an attic vent.

FIG. 2 illustrates an embodiment of the smart attic fan assembly 100 that is mounted onto a framing 20 that surrounds an attic vent 30. The smart attic fan assembly 100 can include a housing 102. The housing 102 can include mounting tabs 104 that allow the smart attic fan assembly 100 to be attached to a portion of the building structure. In the illustrated embodiment, the mounting tabs 104 have a plurality of through holes that each allow a screw 106 to be passed through the through hole and screwed into the framing 20. As shown in FIG. 2, the smart attic fan assembly 100 can be attached to the framing 20 so that the air outflow from the smart attic fan assembly 100 is directed substantially perpendicular to the opening of the attic vent 30.

The smart attic fan assembly 100 can include a bracket 108 that secures the motor 200 to the housing 102. In the illustrated embodiment, the housing 102 is substantially cylindrical and the bracket 108 holds the motor 200 substantially coaxial with the cylindrical housing 102. The smart attic fan assembly 100 can include a grill 110 that covers the inflow end of the housing 102. The grill 110 can have an open wireframe structure that is arranged so that the grill 110 does not substantially interfere with air flow through the housing 102. The housing 102 can include a port 112 that allows the power cord 700 to pass through the housing 102 to reach the motor 200. In the illustrated embodiment, the user interface 500 is attached to a junction box 704 that supplies power to the smart attic fan assembly 100.

Figure 3B:
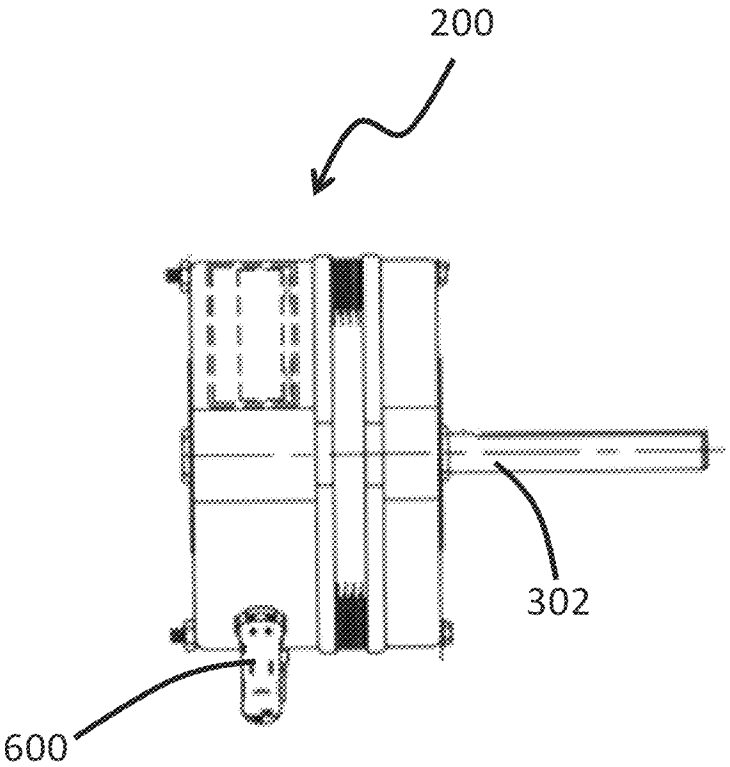
FIG. 3B is a side view of the motor of FIG. 3A.
Figure 3A:
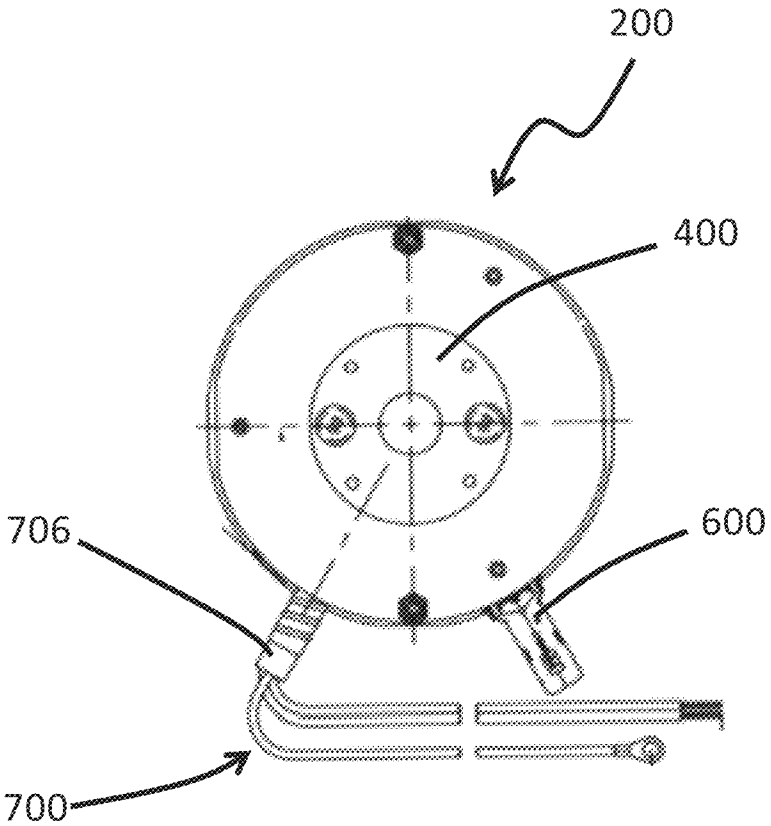
FIG. 3A is an end view of a motor of a smart attic fan assembly.

FIGS. 3A and 3B illustrate an embodiment of the motor 200 having the control unit 400 mounted onto the motor 200. The motor 200 can have a substantially cylindrical shape. The control unit 400 can be disposed on a base of the substantially cylindrical motor 200, as shown in FIG. 3A. The control unit 400 can be mounted on an external surface of the motor 200, as shown in FIG. 3A. In some arrangements, the control unit 400 can be mounted on an internal surface of the motor 200. For example, the control unit 400 can be located within a housing of the motor 200. The fan drive shaft 302 can extend from the motor base that is opposite of the control unit 400, as shown in FIG. 3B. The power cord 700 can include a ferrule 706 by which the power cord 700 attaches to the motor 200. The ferrule 706 can be disposed on the side of the motor 200, as shown in the illustrated embodiment. The motor 200 can include a sensor 600 (e.g., a temperature sensor 604, a humidistat 606) that is disposed on the side of the substantially cylindrical motor 200 and is circumferentially spaced apart from the ferrule 706. As shown in FIG. 3A, the sensor 600 can be located in the air flow path of the smart attic fan assembly 100. The sensor 600 can be positioned in the air flow path of the smart fan to inform the control unit 400 of the temperature or humidity of the air that is being exhausted from the attic by the smart attic fan assembly 100.

Figure 4B:
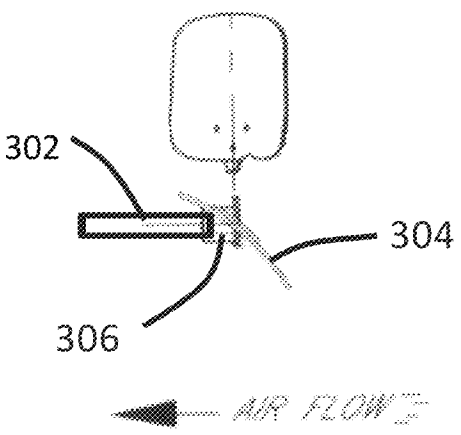
FIG. 4B is a side view of the blade of FIG. 4A.
Figure 4A:
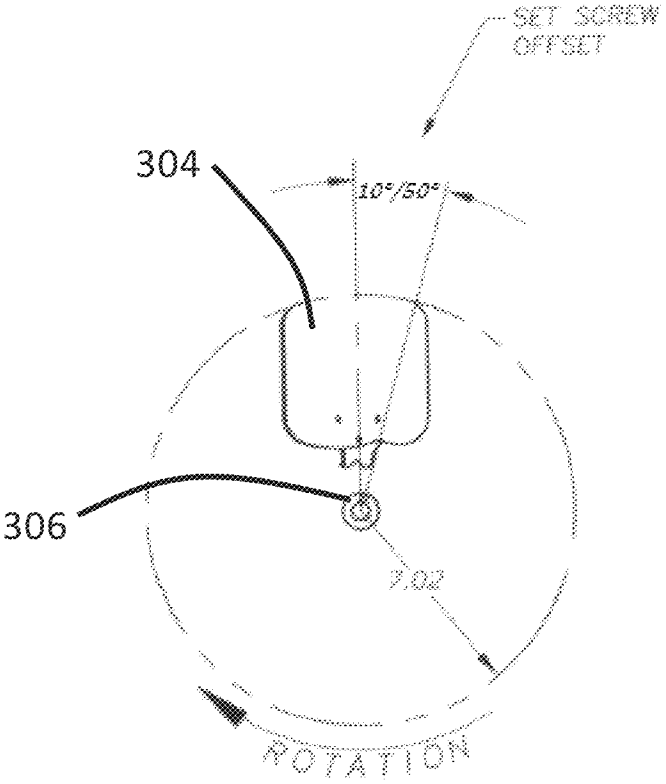
FIG. 4A is a front view of a blade of a smart attic fan assembly.

FIGS. 4A and 4B illustrate an embodiment of a blade 304 of the blade assembly 300. The blade 304 can be attached to and radiate from a central hub 306. FIG. 4B illustrates a top view of the blade assembly 300, showing an edge view of the blade 304 that is aligned over top of the central hub 306. The blade face can be seen for the blade 304 that is not aligned over top of the central hub 306. The central hub 306 can be rotationally secured to the fan drive shaft 302 so that the central hub 306 rotates with the fan drive shaft 302. In FIG. 4A, only one of the blades 304 of the fan blade assembly 300 is shown. In some arrangements, the fan blade assembly 300 includes three identical blades 304 that are circumferentially space equally about the central hub 306. In the illustrated embodiment, the blade 304 has a nominal pitch of 19°. In some embodiments, the blade 304 has a nominal pitch that is in the range between 10° and 50°, as indicated in FIG. 4A. The size and angle of the blade 304 relative to the longitudinal axis of the fan assembly drive shaft 302 can be selected so that the fan blade assembly 300 provides maximum efficiency over the range of rpms at which the smart attic fan assembly 100 operates.

Figure 5:
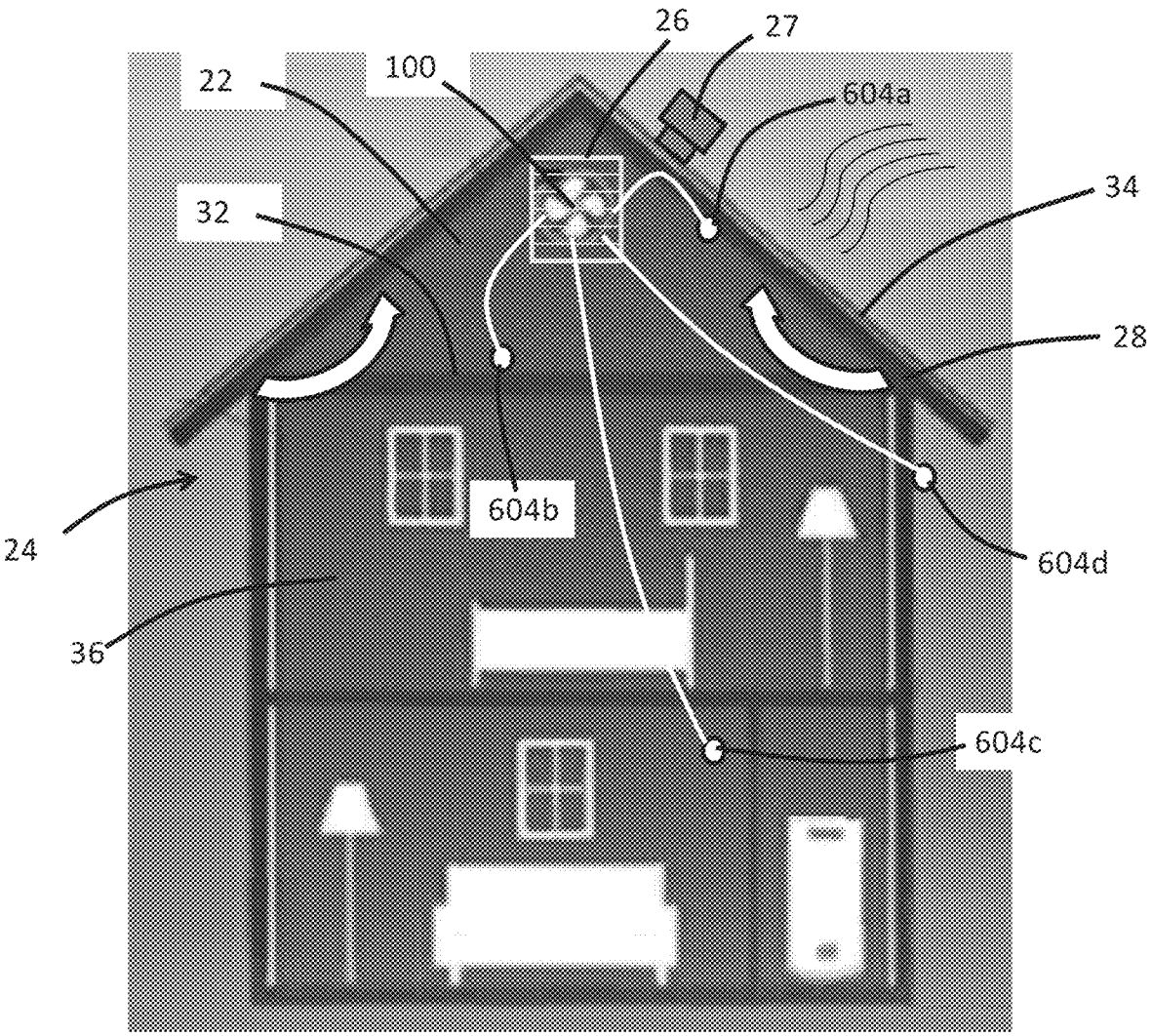
FIG. 5 illustrates a smart attic fan assembly mounted in an attic of a home.

FIG. 5 illustrates an embodiment of the smart attic fan assembly 100 installed in an attic 22 of a home 24. The smart attic fan assembly 100 can be installed in a vented attic. The smart attic fan assembly 100 can be installed in a sealed or conditioned attic. As described in more detail below, the smart attic fan assembly 100 can adjust its operational parameters in order to efficiently cool the attic 22. The smart attic fan assembly 100 can avoid or reduce overheating of the attic 22 in order to cool the attic 22 and the living space 36 more efficiently than other attic fans known in the art. The smart attic fan assembly 100 can prevent or reduce attic overheating to avoid premature failure of building materials (e.g., roofing, sheathing, joists, rafters, insulation, air conditioning ducts, etc.). The smart attic fan assembly 100 can reduce attic humidity to avoid premature failure of building materials (e.g., roofing, sheathing, joists, rafters, insulation, air conditioning ducts, etc.). In some modes, the smart attic fan assembly 100 can remove super-heated attic air near the roof 34 of the attic 22 to avoid the air near the roof 34 transferring its heat to the air near the floor 32 of the attic 22. In certain variants, the smart attic fan assembly 100 can adjust its operational parameters based on temperature readings detected in the attic 22. In some arrangements, the smart attic fan assembly 100 can rapidly increase and decrease fan rpm in a pulsatile fashion in order to disrupt a temperature gradient in the attic 22. In some arrangements, the smart attic fan assembly 100 can operate the fan at a substantially constant rpm to minimize disruption of a temperature gradient in the attic 22.

With continued reference to FIG. 5, solar heating (denoted as a set of parallel wavy arrows in FIG. 5) can increase the temperature of a roof 34 of a house 24. In some cases, solar heating can raise the temperature of the roof 34 to over 150° F. Heat from the hot roof 34 can be transferred by conduction to the air in the attic 22 that is adjacent to the hot roof 34. In addition, warmer air within the attic 22 can rise and accumulate near the roof 34. Heat from the attic 22 can find its way to the living space 36 of the home 24 by conduction through the insulation at the attic floor 32 or through the A/C duct work, causing the temperature of the living space 36 to increase. Heat entering the living space 36 from the attic 22 can cause an air-conditioning system to run longer and work harder to cool the living space 36.

As shown in FIG. 5, the smart attic fan assembly 100 can be mounted in a gable vent 26 or roof mount vent 27 of the home 24. The smart attic fan assembly 100 can be installed in an attic 22 that is ventilated or in an attic 22 that is closed with controlled venting. The attic 22 can include soffit vents 28 or other vents (e.g., ridge vents, gable vents, dormer vents, etc.) that allow outside air to enter the attic 22 (as shown by the curved, open arrows in FIG. 5). The soffit vents 28 can be located at or near the floor 32 of the attic 22. The gable vent 26 can be disposed near the roof 34 of the home. The attic air near the roof 34 can have a higher temperature than the attic air near the floor 32. As described in more detail below, the smart attic fan assembly 100 can adjust its operation to preferentially exhaust the hotter attic air near the roof 34 in order to prevent or avoid overheating of the attic 22. The smart attic fan assembly 100 can reduce the attic air near the roof 34 warming the attic air near the floor 32. By removing the super-heated air near the roof 34 before it warms the attic air near the floor 32, the smart attic fan assembly 100 can minimize heat conduction through the floor 32 and into the living space 36. Super-heated air in the attic 22 can also increase the temperature of the attic building structures (e.g., joists, studs), creating an overheated attic. The building structures of an overheated attic can act as a thermal reservoir, heating cool outside air that is pulled in through the soffit vents 28 and compromising the cooling effect of the attic fan. The smart attic fan assembly 100 can avoid or reduce overheating of the attic 22, as described in more detail below. The smart attic fan assembly 100 can reduce humidity of the attic 22, as described in more detail below.

As described above with regard to FIG. 1, the smart attic fan assembly 100 can adjust the rpm of the motor 200 in response to an input from a sensor 600. In some embodiments, the smart attic fan assembly 100 can adjust the rpm of motor 200 in response to an input from a temperature sensor 604. The smart attic fan assembly 100 can include a first temperature sensor 604*a* located near the roof 34, or a second temperature sensor 604*b* located near the attic floor 32, or a third temperature sensor 604*c* located in the living space 36, or a fourth temperature sensor 604*d* located outside, or any combination of the aforementioned temperature sensors 604*a-d*. For example, the smart attic fan assembly 100 can include only a first temperature sensor 604*a* located near the roof 34. The temperature sensors 604*a-d* are shown as being wired to the smart attic fan assembly 100. However, in some arrangements the sensors 604*a-d*, or any of the sensors 600 mentioned herein, can be connected to the smart attic fan assembly 100 by a wired or a wireless connection. The smart attic fan assembly 100 can adjust the rpm of the fan assembly 300 based on a reading from the first temperature sensor 604*a* to avoid overheating of the attic 22.

In some arrangements, the smart attic fan assembly 100 can increase its rpm as the attic 22 warms, to prevent the attic 22 from overheating. For example, the smart attic fan assembly 100 can operate at a low rpm (e.g., 30% of full rpm or less than 10% Watts) when the temperature of the attic air near the roof 34 is above a first temperature. The smart attic fan assembly 100 can operate at a moderate rpm (e.g., 50% of full rpm or less than 25% Watts) when the temperature of the attic air near the roof 34 is above a second temperature, the second temperature being hotter than the first temperature. The smart attic fan assembly 100 can operate at a high rpm (e.g., 100% of full rpm or 100% Watts) when the temperature of the attic air near the roof 34 is above a third temperature, the third temperature being hotter than the second temperature. Ramping up the rpm in response to the present temperature conditions of the attic 22 can allow the smart attic fan assembly 100 to cool the attic 22 more efficiently compared to a simple thermostat-controlled fan that only runs at full power and only turns on once the attic air crosses a certain temperature. Ramping up the rpm in response to the present temperature conditions of the attic 22 can avoid having to frequently switch the fan on and off. Frequent switching of the fan on and off is inefficient because the motor must repeatedly re-establish fan inertia that is wasted when the fan is shut off. Frequent switching of the fan on and off can impose more wear on fan components. A simple thermostat-controlled fan can attempt to reduce the frequency of the fan switching on and off by increasing the hysteresis of the thermostat, i.e., the range between the "fan-on" setpoint temperature and the "fan-off" setpoint temperature. Increasing the thermostat hysteresis can result in the attic 22 becoming overheated before the thermostat signals the fan to turn on. The smart attic fan assembly 100 can avoid overheating of the attic 22 by ramping up the rpm in response to the present temperature conditions of the attic 22. The smart attic fan assembly 100 can avoid motor wear by avoiding frequent switching on and off of the motor 200. The smart attic fan assembly 100 can improve efficiency by preserving fan inertia.

Table 1 shows illustrative, non-limiting data for power consumption and air flow of a smart attic fan assembly 100. In the illustrated embodiment, the smart attic fan assembly 100 produces an air flow of 2830 cubic feet per minute (CFM) when the smart attic fan assembly 100 is operating at full power, which corresponds to a fan speed of 1550 rpm. The power consumption of the smart attic fan assembly 100 when it is operating at full power is 163 Watts.

TABLE 1

1/7 ECM Motor in a 16-inch diameter housing.

| Temp (F.) | 140 | 135 | 130 | 125 | 120 | 115 | 110 | 105 | 100 | 95 | 90 | 85 | 80 | 75 |
|---|---|---|---|---|---|---|---|---|---|---|---|---|---|---|
| RPM Percentage | 100 | 100 | 100 | 100 | 95 | 90 | 85 | 80 | 75 | 70 | 65 | 50 | 30 | 0 |
| Actual RPMs | 1550 | 1550 | 1550 | 1550 | 1400 | 1300 | 1200 | 1100 | 1000 | 900 | 800 | 700 | 500 | 0 |
| CFM | 2830 | 2830 | 2830 | 2830 | 2500 | 2356 | 2119 | 2014 | 1841 | 1641 | 1513 | 1343 | 963 | 0 |
| Watts | 163 | 163 | 163 | 163 | 117 | 99 | 79 | 60 | 49 | 34 | 25 | 18 | 7.2 | 0 |
| Amps | 2.4 | 2.4 | 2.4 | 2.4 | 1.67 | 1.5 | 1.15 | 0.9 | 0.73 | 0.53 | 0.4 | 0.28 | 0.13 | 0 |
| CFM/Watt | 17 | 17 | 17 | 17 | 21 | 24 | 27 | 34 | 38 | 48 | 61 | 75 | 134 | 0 |

Table 2 shows illustrative, non-limiting data for power consumption and air flow of a smart attic fan assembly 100 that is programmed to turn on when the smart attic fan assembly 100 detects a relative humidity of 60%. In some embodiments, the smart attic fan assembly 100 can be programmed to turn on when the smart attic fan assembly detects a relative humidity other than 60% (e.g., 40%, 50%, 65%, 70%, 80%). In the illustrated embodiment, the smart attic fan assembly 100 that is programmed to turn off when the smart attic fan assembly 100 detects a relative humidity of 55%. In some embodiments, the smart attic fan assembly 100 can be programmed to turn off when the smart attic fan assembly 100 detects a relative humidity other than 55% (e.g., 20%, 40%, 50%, 60%, 70%).

TABLE 2

Humidity control of 1/7 ECM Motor in a 16-inch diameter housing.

| | On | Off |
|---|---|---|
| Relative Humidity | 60% | 55% |
| RPMs | 500 | 0 |
| CFM | 963 | 0 |
| Watts | 7.2 | 0 |
| Amps | 0.13 | 0 |

As discussed in more detail below, the smart attic fan assembly 100 can be programmed to respond to environmental conditions (e.g., humidity, temperature). For example, the smart attic fan assembly 100 can include a central processor that receives input from a humidistat sensor and a temperature sensor. The central processor can output a signal to the motor 200 of the smart attic fan assembly 100 based on the input received from the humidistat sensor and the temperature sensor. In some embodiments, the central processor can be programmed to give greater weight to the input from the temperature sensor when evaluating the output signal to send to the motor 200. In some embodiments, the central processor can be programmed to give greater weight to the input from the humidistat when evaluating the output signal to send to the motor 200. In certain variants, the central processor can output a signal to the motor 200 of the smart attic fan assembly 100 based on the input received from only one type of sensor (e.g., a temperature sensor). In some embodiments, the central processor can output a signal to the motor 200 of the smart attic fan assembly 100 based on the input received from only one sensor (e.g., a single temperature sensor).

In some arrangements, the smart attic fan assembly 100 can adjust its operation in response to a detected temperature gradient. For example, the smart attic fan assembly 100 can compare a reading from a first temperature sensor 604*a* near the roof to a reading from a second temperature sensor 604*b* near the floor 32 to detect a temperature difference. The smart attic fan assembly 100 can operate at a low rpm (e.g., 30% full power) when the temperature difference is above a first value and below a second value. The smart attic fan assembly 100 can operate at a moderate rpm (e.g., 50% full power) when the temperature difference is above a second value and below a third value. The smart attic fan assembly 100 can operate at a high rpm (e.g., 100% full power) when the temperature difference is above the third value.

In some arrangements, the smart attic fan assembly 100 can adjust its operation to promote mixing of air within the attic 22. For example, the smart attic fan assembly 100 can rapidly pulse between a low rpm (e.g., 30% full power) and a high rpm (e.g., 100% full power) mode of operation in order to promote mixing of attic air. Mixing of air within the attic 22 can promote lowering the temperature of the air near the attic floor 32, thereby reducing heat conduction from the attic 22 into the living space 36.

In some arrangements, the smart attic fan assembly 100 can adjust its operation to avoid mixing of air within the attic 22. For example, the smart attic fan assembly 100 can slowly ramp up from a low rpm (e.g., 30% full power) to a high rpm (e.g., 100% full power) to maintain a laminar draw of air that removes more air from the space near the roof 34 compared to the space near the floor 32. The smart attic fan assembly 100 can avoid mixing of the air within the attic 22 in order to minimize heat transfer between attic air near the roof 34 and attic air near the floor 32, thereby reducing heat conduction from the attic 22 into the living space 36.

Figure 6:
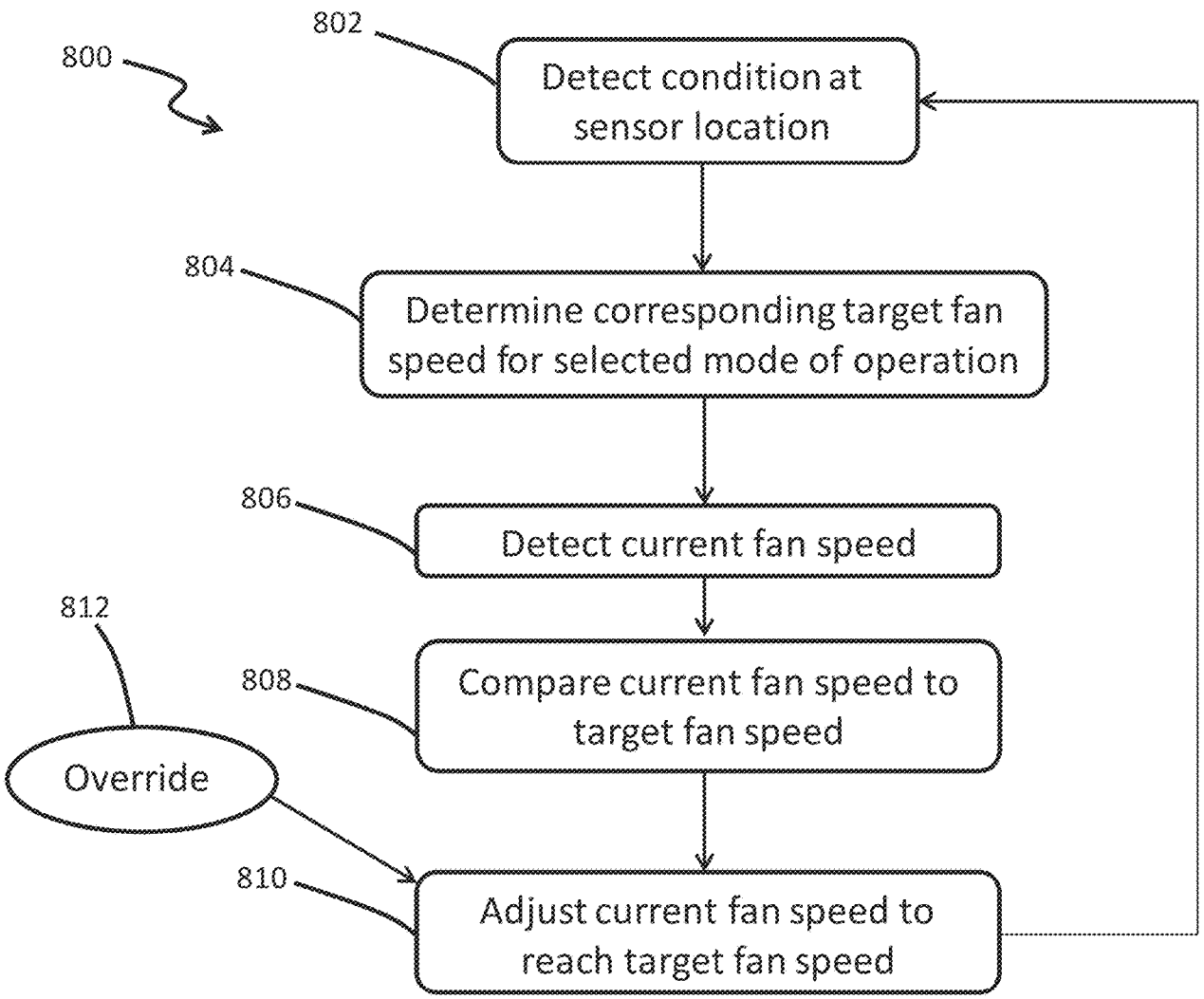
FIG. 6 illustrates an illustrative logic flow path for controlling operation of the smart attic fan assembly.

FIG. 6 illustrates a non-limiting, illustrative logic path 800 of the smart attic fan assembly 100. In some embodiments, the logic path 800 can be programmed into the control unit 400 of the smart attic fan assembly 100. The control unit 400 can be programmed with more than one logic paths. A user can select the desired logic path from the one or more logic paths that are programmed into the control unit 400. For example, the control unit 400 can have a high efficiency logic path and a high cooling logic path. The high efficiency logic path can operate the smart attic fan assembly 100 to minimize power consumption while sacrificing somewhat the cooling function of the smart attic fan assembly 100. The high cooling logic path can operate the smart attic fan assembly 100 to maximize the cooling function of the smart attic fan assembly 100 while sacrificing somewhat power efficiency. The user can select the desired logic path that the control unit 400 should execute to control operation of the motor 200. For example, the user can use the user interface 500 (shown in FIG. 1) to select the logic path the control unit 400 is to execute.

With continued reference to FIG. 6, the logic path 800 can include a sensor detection step 802. The sensor detection step 802 can include the control unit 400 receiving an input from a sensor 600, as discussed above. In some embodiments, the sensor detection step 802 includes the control unit 400 receiving a temperature reading from a temperature sensor 604. The logic flow path 800 can include a lookup step 804. The lookup step 804 can include the control unit 400 determining the speed at which the smart attic fan assembly 100 should operate based on the reading received by the control unit 400 from the sensor 600. For example, referring briefly back to Table 1, the smart attic fan assembly 100 may determine in the lookup step 804 that the motor 200 should operate at 1000 rpm when the temperature sensor 604 indicates the temperature is 100° F. The speed at which the smart attic fan assembly 100 should operate based on a reading received by the control unit 400 from a sensor 600 will be referred to herein as the "target fan speed." The control unit 400 can include a lookup table or other means to inform the control unit 400 of the target fan speed that corresponds to the information (e.g., temperature, humidity) that is received by the control unit 400 from the one or more sensors 600.

Referring again to FIG. 6, the logic path 800 can include a fan speed detection step 806. The fan speed detection step 806 can include the control unit 400 receiving a signal from a speed sensor 602, as discussed above. The logic path 800 can include a comparison step 808. The comparison step 808 can include the control unit 400 determining whether the current fan speed is greater than, less than, or equal to the target fan speed. The logic flow path 800 can include a motor control step 810. The motor control step 810 can include the control unit 400 sending a motor signal 402 to the motor 200, as discussed above. The motor control step 810 can include the control unit 400 modifying operation of the motor 200 so that the speed of the motor 200 matches the target fan speed. For example, if the control unit 400 determines that the current speed of the motor 200 is less than the target fan speed, the control unit 400 can send to the motor 200 a motor signal 402 that causes the motor 200 to increase the rpm at which the motor 200 is operating. The logic path 800 can continuously cycle through the control loop, as shown by the return arrow that extends from the motor control step 810 to the sensor detection step 802.

In some arrangements, the logic path 800 can include an override step 812 that allows an input from a mobile device 1000 or the user interface 500 (shown in FIG. 1) to override the automatic operation of the logic path 800. For example, a user can send a signal from a mobile device 1000 to increase the speed of the motor 200 even though the motor control step 810 has not determined that the speed of the motor 200 should be increased. The override step 812 can temporarily suspend the automatic operation of the logic path 800 to avoid the logic path 800 negating the effect of the input received in the override step 812.

Figure 7B:
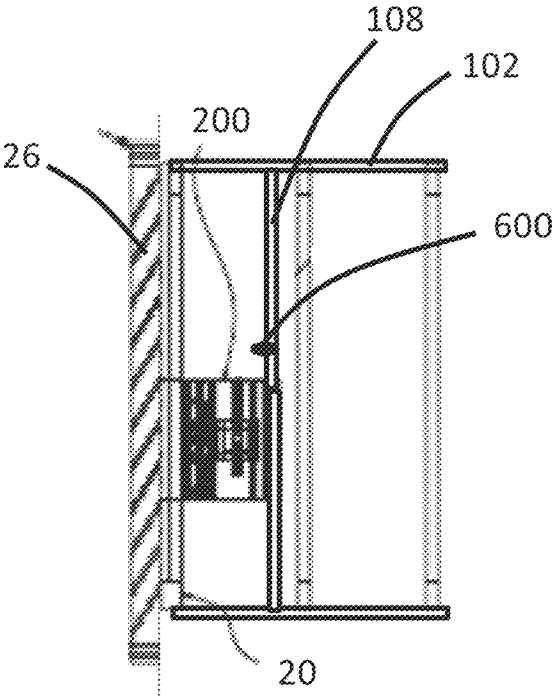
FIG. 7B is a side view of the smart attic fan assembly of FIG. 7A.
Figure 7A:
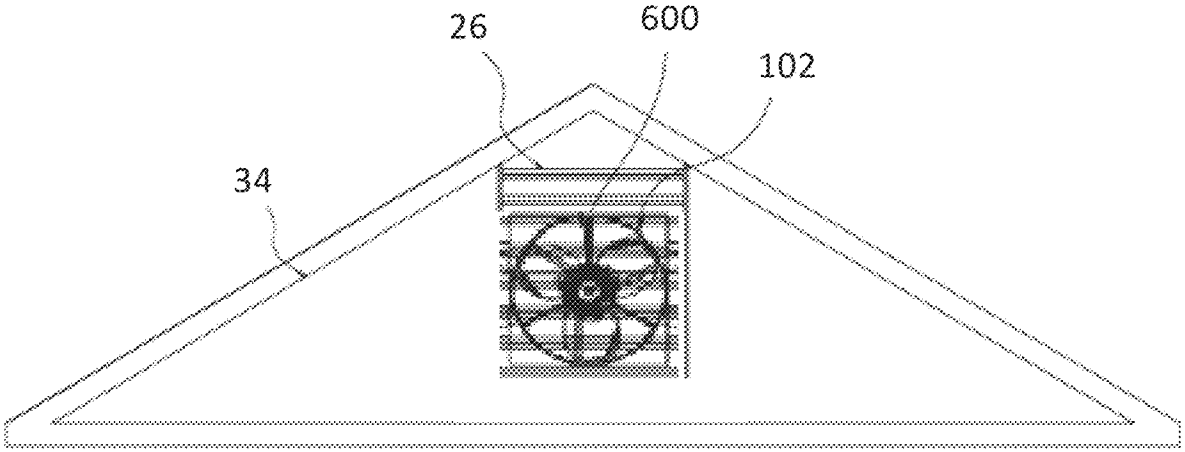
FIG. 7A is a front view of a smart attic fan assembly that is installed in a gable vent and has a temperature sensor mounted on a bracket of the smart attic fan assembly.
Figure 8B:
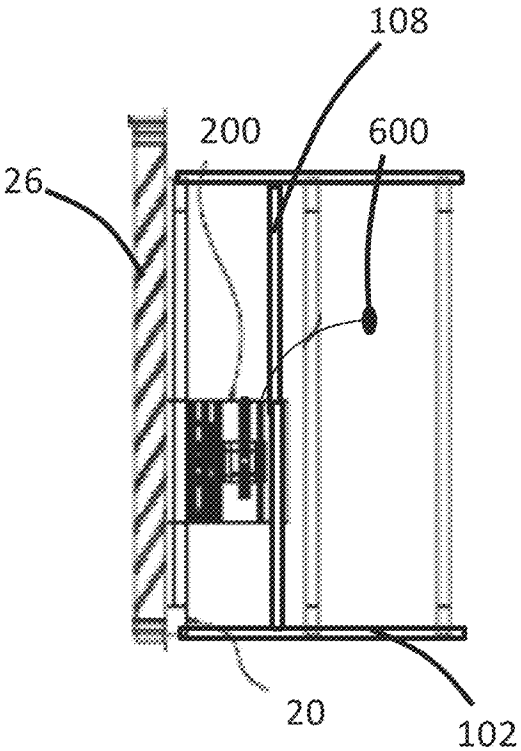
FIG. 8B is a side view of the smart attic fan assembly of FIG. 8A.
Figure 8A:
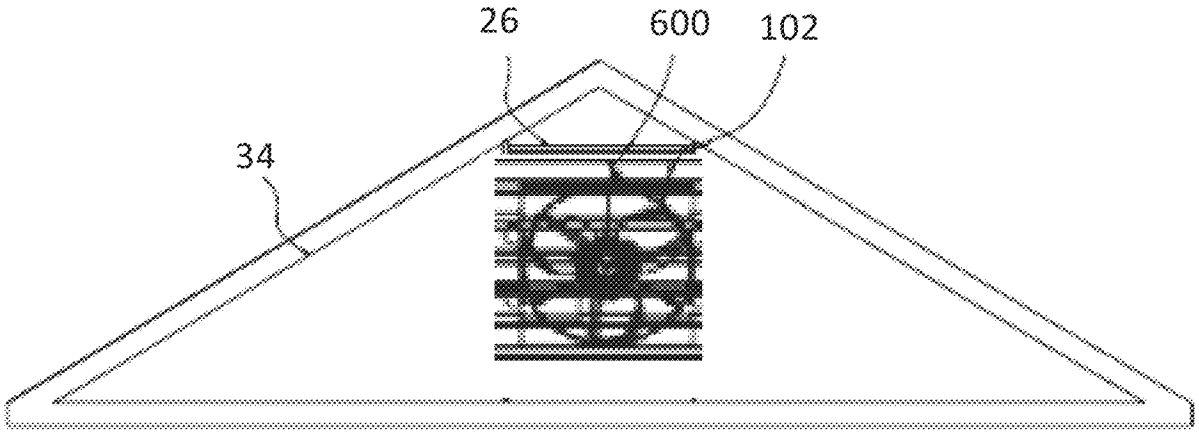
FIG. 8A is a front view of a smart attic fan assembly that is installed in a gable vent and has a temperature sensor mounted on a housing of the smart attic fan assembly.
Figure 9B:
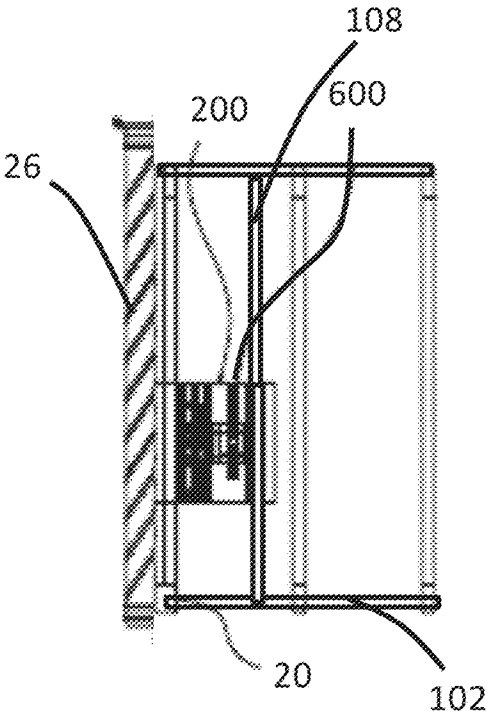
FIG. 9B is a side view of the smart attic fan assembly of FIG. 9A.
Figure 9A:
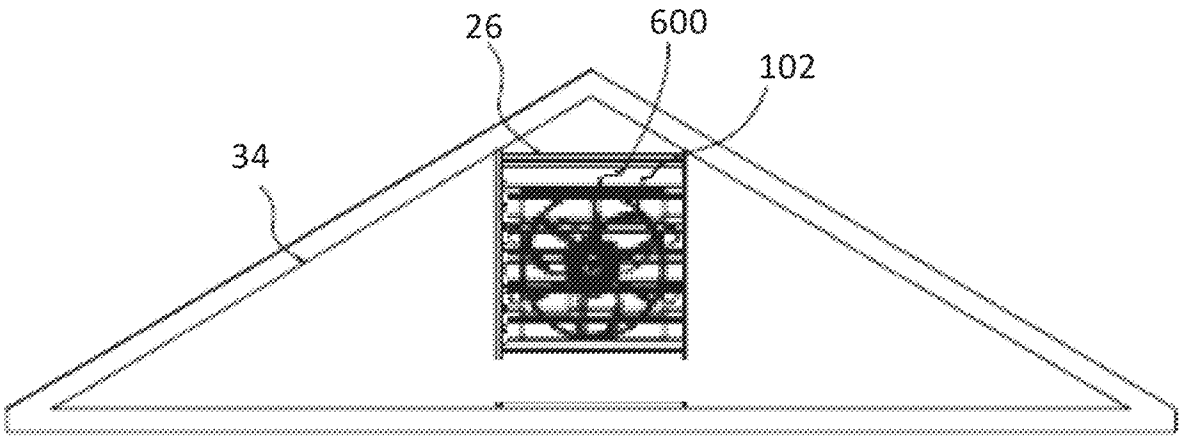
FIG. 9A is a front view of a smart attic fan assembly that is installed in a gable vent and has a temperature sensor mounted on a motor of the smart attic fan assembly.
Figure 10B:
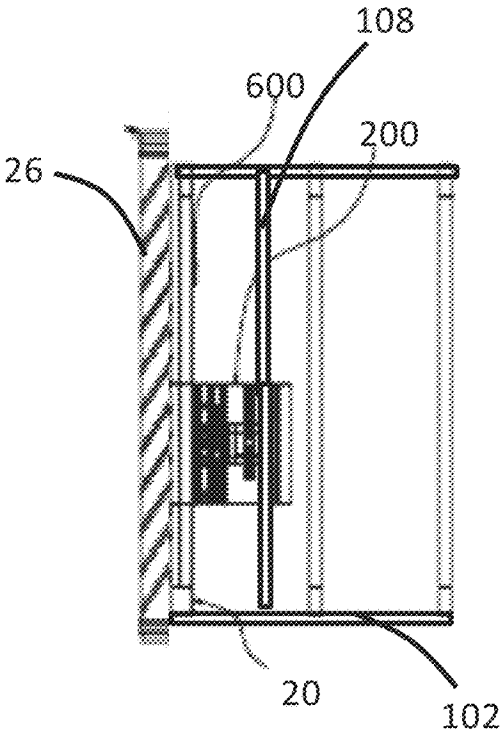
FIG. 10B is a side view of the smart attic fan assembly of FIG. 10A.
Figure 10A:
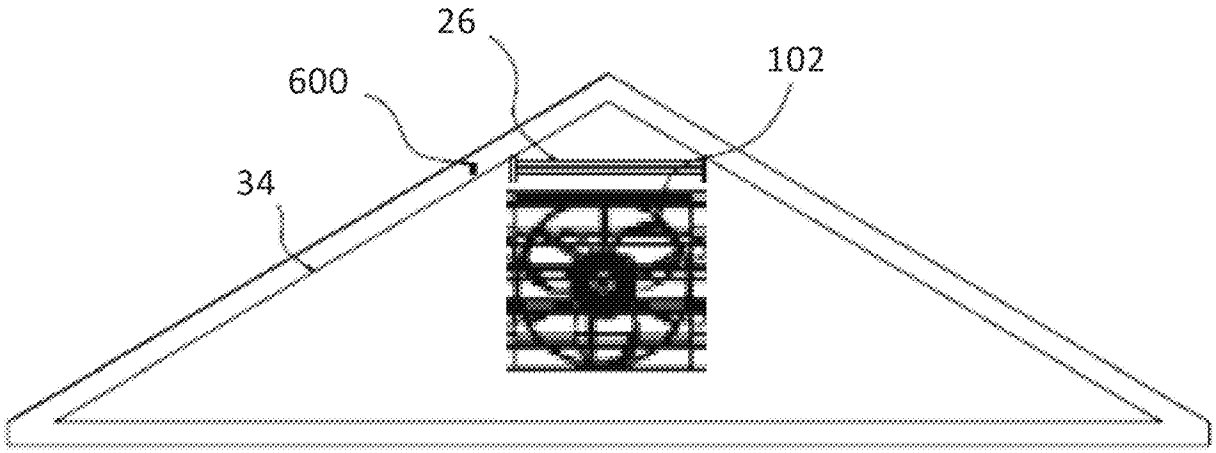
FIG. 10A is a front view of a smart attic fan assembly that is installed in a gable vent and has a temperature sensor mounted on a rafter of the building structure.

FIGS. 7A-10B illustrate different placements of the sensor 600 for the smart attic fan assembly 100. The sensor 600 can be a temperature sensor 604 or a humidistat 606. In FIGS. 7A and 7B, the sensor 600 is mounted on the bracket 108 that connects the motor 200 to the housing 102. In FIGS. 8A and 8B, the sensor 600 is mounted on the housing 102 of the smart attic fan assembly 100. In the illustrated embodiment, the sensor 600 is mounted on the inside surface of the cylindrical housing 102 and is longitudinally upstream of the motor 200. In some embodiments, the sensor 600 can longitudinally overlap with the motor 200. In some embodiments, the sensor 600 is mounted on the outside surface of the cylindrical housing 102. In FIGS. 9A and 9B, the sensor 600 is mounted on the motor 200. In FIGS. 10A and 10B, the sensor 600 is mounted on a rafter of the building structure.

As mentioned, the smart attic fan assembly 100 can be used to reduce or avoid overheating of the attic 22 as well as to reduce humidity in the attic 22. In cold weather or in winter, the smart attic fan assembly 100 can remove humid air from the attic 22 to avoid or prevent condensation on the building materials of the attic 22 (e.g., insulation, joists, rafters, etc.). In winter, the smart attic fan assembly 100 can be set to keep the attic cold to avoid ice dams forming on the roof. For example, in winter months, the temperature set point of the smart attic fan assembly 100 can be set to a low temperature to avoid warm air accumulating in the attic 22. Warm air in the attic 22 can cause ice dams to form by causing snow to melt near the warmer peak of the roof and to refreeze near the cooler eaves of the roof. In winter months, the smart attic fan assembly 100 can be set to keep the moisture low in the attic. For example, in winter months, the humidity set point of the smart attic fan assembly 100 can be set to a low humidity level to avoid humid air accumulating in the attic and condensing on the building materials of the attic 22. Preventing humid air from condensing on the building materials of the attic 22 can prolong the life of the attic building materials, as discussed above.

All of the features disclosed in this specification (including any accompanying exhibits, claims, abstract and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract and drawings), or to any novel one, or any novel combination, of the steps of any method or process so disclosed.

Those skilled in the art will appreciate that in some embodiments, the actual steps taken in the processes illustrated or disclosed may differ from those shown in the figures. Depending on the embodiment, certain of the steps described above may be removed, others may be added. For example, the actual steps or order of steps taken in the disclosed processes may differ from those shown in the figure. Depending on the embodiment, certain of the steps described above may be removed, others may be added. For instance, the various components illustrated in the figures may be implemented as software or firmware on a processor, controller, ASIC, FPGA, or dedicated hardware. Hardware components, such as processors, ASICs, FPGAs, and the like, can include logic circuitry. Furthermore, the features and attributes of the specific embodiments disclosed above may be combined in different ways to form additional embodiments, all of which fall within the scope of the present disclosure.

Conditional language, such as "can," "could," "might," or "may," unless specifically stated otherwise, or otherwise understood within the context as used, is generally intended to convey that certain embodiments include, while other embodiments do not include, certain features, elements, or steps. Thus, such conditional language is not generally intended to imply that features, elements, or steps are in any way required for one or more embodiments or that one or more embodiments necessarily include logic for deciding, with or without user input or prompting, whether these features, elements, or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. Likewise the term "and/or" in reference to a list of two or more items, covers all of the following interpretations of the word: any one of the items in the list, all of the items in the list, and any combination of the items in the list. Further, the term "each," as used herein, in addition to having its ordinary meaning, can mean any subset of a set of elements to which the term "each" is applied. Additionally, the words "herein," "above," "below," and words of similar import, when used in this application, refer to this application as a whole and not to any particular portions of this application.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

Various modifications to the implementations described in this disclosure may be readily apparent to those skilled in the art, and the generic principles defined herein may be applied to other implementations without departing from the spirit or scope of this disclosure. Thus, the disclosure is not intended to be limited to the implementations shown herein, but is to be accorded the widest scope consistent with the principles and features disclosed herein. Certain embodiments of the disclosure are encompassed in the claim set listed below or presented in the future.

What is claimed is:

1. An automated cooling system for energy efficient use with an attic space of a building structure, the automated cooling system comprising:

a cylindrical housing configured to be mounted to the building structure having the attic space, the cylindrical housing comprising an inflow end and an outflow end, the cylindrical housing configured to be secured to a roof over the attic space of the building structure;

a motor configured to rotate a fan drive shaft;

a fan blade assembly secured to the fan drive shaft so that rotation of the fan drive shaft causes the fan blade assembly to rotate, wherein the motor and the fan blade assembly are disposed within the cylindrical housing and configured to draw air from the attic space into the cylindrical housing through the inflow end and to exhaust air out of the attic space through the outflow end of the cylindrical housing;

a first condition sensor comprising a temperature sensor and a second condition sensor comprising a humidity sensor; and a motor speed control unit configured to communicate with each of the first and second condition sensors and configured to receive a first condition sensor signal from the first condition sensor and further configured to receive a second condition sensor signal from the second condition sensor, the motor speed control unit electronically coupled to the motor and configured to change a speed at which the motor rotates the fan drive shaft, the motor speed control unit configured to access a first lookup table and a second lookup table, wherein the motor speed control unit is configured to determine a target speed based on a value of the first condition sensor signal using the first lookup table, wherein the motor speed control unit is configured to determine the target speed based on a value of the second condition sensor signal using the second lookup table, wherein the motor speed control unit is configured to determine an air temperature of the attic space based on the first condition sensor signal and compare the air temperature to a desired temperature, wherein the motor speed control unit is configured to maintain a temperature of the attic space at the desired temperature by ramping speeds of the motor via sending a first motor signal for the motor to operate at a first target speed based on the air temperature being equal to the desired temperature, sending a second motor signal for the motor to operate at a second target speed based on the air temperature being higher than the desired temperature, the second target speed being greater than the first target speed, and sending a third motor signal for the motor to operate at a third target speed based on the air temperature being lower than the desired temperature, the third target speed being less than the first target speed, such that motor speed is automatically adjusted in response to changes in the air temperature in the attic space so as to maintain the temperature of the attic space at the desired temperature without switching on and off the motor to preserve fan blade inertia while maintaining the temperature of the attic space at the desired temperature.

2. The automated cooling system of claim 1, further comprising a speed sensor, wherein the motor speed control unit is electronically coupled to the speed sensor and configured to receive a speed signal from the speed sensor.

3. The automated cooling system of claim 2, wherein the speed sensor is a Hall effect sensor configured to detect passing of a magnet on the fan drive shaft.

4. The automated cooling system of claim 2, wherein the motor speed control unit is configured to determine a present speed based on the speed sensor, send a fourth motor signal to increase the speed when the target speed is greater than the present speed, send a fifth motor signal to decrease the speed when the target speed is less than the present speed, and send a sixth motor signal to keep the speed unchanged when the target speed equals the present speed.

5. The automated cooling system of claim 1, wherein the motor is an electronically commutated motor.

6. The automated cooling system of claim 1, wherein the motor and the fan blade assembly are disposed in a roof mount vent.

7. An automated cooling system for use with a building structure, the automated cooling system comprising:

a motor configured to rotate a fan drive shaft;

a fan blade assembly rotationally secured to the fan drive shaft so that rotation of the fan drive shaft causes the fan blade assembly to rotate;

a housing configured to be secured to the building structure having an attic space, the housing comprising an inflow end and an outflow end, the motor and the fan blade assembly connected to the housing and configured to draw air from the attic space into the housing through the inflow end and to exhaust air out of the housing through the outflow end to exhaust air out of the attic space;

a condition sensor comprising a temperature sensor;

an other condition sensor comprising a humidity sensor; and a control unit configured to communicate with the condition sensor and configured to receive a condition sensor signal from the condition sensor, the control unit configured to communicate with the motor and configured to change a speed at which the motor rotates the fan drive shaft, wherein the control unit is configured to determine an air temperature based on the condition sensor signal and compare the air temperature to a desired temperature, wherein the control unit is configured to maintain a temperature of the attic space at the desired temperature by sending a first motor signal for the motor to operate at a first speed based on the air temperature being higher than the desired temperature, and sending a second motor signal for the motor to operate at a second speed based on the air temperature being lower than the desired temperature, the second speed being less than the first speed, such that motor speed is automatically adjusted in response to changes in the air temperature in the attic space so as to maintain the temperature of the attic space at the desired temperature without switching on and off the motor to preserve fan blade inertia while maintaining the temperature of the attic space at the desired temperature, and wherein the control unit is configured to communicate with the other condition sensor and configured to receive an other condition sensor signal from the other condition sensor, wherein the control unit is configured to determine humidity based on the other condition sensor signal and compare the humidity to a desired humidity, wherein the control unit is configured to start the motor based on the humidity being greater than the desired humidity, and wherein the control unit is configured to stop the motor based on the humidity being less than the desired humidity.

8. The automated cooling system of claim 7, wherein the control unit is configured to send a third motor signal for the motor to operate at a third speed based on the air temperature being equal to the desired temperature, the third speed being less than the first speed and greater than the second speed.

9. The automated cooling system of claim 7, wherein the control unit is configured to allow a user to set the desired temperature.

10. The automated cooling system of claim 7, wherein the control unit is configured to send a third motor signal for the motor to speed up based on the humidity being greater than the desired humidity, and wherein the control unit is configured to send a fourth motor signal for the motor to slow down based on the humidity being less than the desired humidity.

11. The automated cooling system of claim 7, wherein the control unit is configured to allow a user to set the desired humidity.

12. The automated cooling system of claim 7, wherein the control unit is configured to determine a target speed based on a value of the condition sensor signal using a lookup table.

13. The automated cooling system of claim 7, wherein the control unit is configured to determine a target speed based on a value of the other condition sensor signal using a lookup table.

14. The automated cooling system of claim 7, wherein the control unit is configured to determine an air humidity based on the other condition sensor signal and compare the air humidity to a humidity datum, and wherein the control unit is configured to stop the motor based on the air humidity being greater than the humidity datum.

15. The automated cooling system of claim 14, wherein the air humidity corresponds to humidity outside of the building structure, and wherein the humidity datum corresponds to humidity in the attic space.

16. The automated cooling system of claim 15, wherein humidity in the attic space is a desired humidity in the attic space.

17. The automated cooling system of claim 7, wherein the housing is configured to be secured to a gable vent of the building structure.

18. The automated cooling system of claim 7, wherein the housing is configured to be secured to a roof vent of the building structure.

19. The automated cooling system of claim 7, wherein the motor and the fan blade assembly are disposed in a roof mount vent.

20. The automated cooling system of claim 7, wherein the motor and the fan blade assembly are configured to exhaust air out of the housing through the outflow end to exhaust air out of the attic space through an opening in a surface of the attic space.

21. The automated cooling system of claim 7, wherein the housing comprises at least two mounting tabs for securing the housing to the building structure.

22. The automated cooling system of claim 7, wherein the motor is configured to rotate the fan blade assembly at 500 to 1,550 revolutions per minute.

23. The automated cooling system of claim 7, wherein the temperature sensor is mounted on a bracket, the bracket connected to the housing and the motor to position the motor in the housing.

24. The automated cooling system of claim 7, wherein the temperature sensor is mounted on a surface of the housing that faces the motor.

25. The automated cooling system of claim 7, wherein the temperature sensor is mounted on an assembly comprising the housing, the motor, the fan blade assembly, or a bracket, and wherein the bracket is connected to the housing and the motor to position the motor in the housing.

26. The automated cooling system of claim 7, wherein the temperature sensor is mounted on the building structure.

27. The automated cooling system of claim 7, wherein the temperature sensor is mounted on a portion of the building structure to which the housing is attached.

28. The automated cooling system of claim 7, wherein the temperature sensor is mounted on an outside surface of the housing.

29. The automated cooling system of claim 7, further comprising a user interface that allows users to set the desired temperature, the user interface in communication with the control unit and configured to transmit a user interface signal to the control unit to inform the control unit of the desired temperature.

30. The automated cooling system of claim 29, wherein the temperature sensor is located on or in the user interface.

31. The automated cooling system of claim 29, wherein the user interface is electronically coupled to the control unit.

32. The automated cooling system of claim 29, wherein the user interface is configured to wirelessly communicate with the control unit.

33. The automated cooling system of claim 29, wherein the user interface comprises a software application for a mobile device.

* * * * *